US005366397A

United States Patent [19]

Suganuma et al.

[11] Patent Number: 5,366,397

[45] Date of Patent: Nov. 22, 1994

[54] WATER JET PROPULSION UNIT

[75] Inventors: Noboru Suganuma; Shigeyuki Ozawa; Ryoichi Nakase, all of Hamamatsu, Japan

[73] Assignee: Sanshin Kogyo Kabushiki Kaisha, Hamamatsu, Japan

[21] Appl. No.: 47,708

[22] Filed: Apr. 14, 1993

[30] Foreign Application Priority Data

Apr. 14, 1992 [JP] Japan ..... 4-120047

[51] Int. Cl.[5] ..... B63B 13/00

[52] U.S. Cl. ..... 440/39; 114/183 R

[58] Field of Search ..... 440/38, 39, 40, 41, 440/42, 43, 44, 47; 114/270, 183 R; 210/163, 348

[56] References Cited

U.S. PATENT DOCUMENTS

| | | | |
|---|---|---|---|
| 4,423,696 | 1/1984 | Aker | 440/40 |
| 4,437,841 | 3/1984 | Stallman | 440/40 |
| 4,699,597 | 10/1987 | Oja | 440/39 |
| 4,787,328 | 11/1988 | Inoue | 440/39 |

FOREIGN PATENT DOCUMENTS

| | | | |
|---|---|---|---|
| 664183 | 6/1963 | Canada | 440/39 |

*Primary Examiner*—Stephen P. Avila

*Attorney, Agent, or Firm*—Knobbe, Martens, Olson & Bear

[57] ABSTRACT

A water jet propulsion unit in which water is drawn off of the jet propulsion unit through a tap for other purposes, such as pumping the bilge with a jet pump or delivering coolant to the engine. A filter element which can be easily serviced is positioned in the conduit for precluding small particles which could clog the conduit from entering the conduit.

12 Claims, 7 Drawing Sheets

WATER JET PROPULSION UNIT

BACKGROUND OF THE INVENTION

This invention relates to a water jet propulsion unit and more particularly to an improved arrangement for drawing water under pressure from such a unit.

The use of water jet propulsion units for powering watercraft is well known and widely accepted. Such units have a variety of advantages over more conventional propeller driven watercraft such as the ability to run in very shallow water. In addition, the jet propulsion unit itself may be employed as a source of external water pressure for a variety of purposes.

For example, it has been the practice to tap water off of the jet propulsion unit and pass it through a venturi type of device for pumping the bilge of the associated watercraft. Alternatively or in addition, a portion of the water pumped by the jet propulsion unit may be drawn off and circulated through the powering internal combustion engine for its cooling.

There is, however, a difficulty in the types of systems that have been previously used for drawing water off from the jet propulsion unit. Because of the ability of jet propulsion units to operate in shallow water, frequently foreign objects may be drawn into the jet propulsion unit and moved by the impeller. Such foreign objects can comprise either sea weed or even small, hard objects such as pebbles or stones. If these foreign objects are pumped into the water drawn off from the jet propulsion unit, they can clog the conduit since such conduits are normally small in size. This is particularly true when venturi type pumps are employed in that the foreign objects can easily clog the throat of the venturi. Obvious disadvantages result from such problems.

It is, therefore, a principal object of this invention to provide an improved jet propulsion unit for a watercraft or the like and which is utilized to pump additional water for an extraneous purpose.

It is a further object of this invention to provide an improved filtering arrangement for the water drawn off from a jet propulsion unit.

It is a yet further object of this invention to provide a simple filter for the external water drawn from the jet propulsion unit and one which may be easily serviced.

SUMMARY OF THE INVENTION

This invention is adapted to be embodied in a jet propulsion unit for a watercraft or the like which comprises a water inlet portion through which water may be drawn from the body of water in which the watercraft is operating, an impeller portion containing a driven impeller for pumping the water and a discharge nozzle through which the water pumped by the impeller is discharged for propelling the associated watercraft. A conduit is connected to the jet propulsion unit for circulating at least a portion of the water pumped by the impeller to another location and a filter is provided in the conduit for precluding foreign particles from entering the conduit.

DETAILED DESCRIPTION OF THE PREFERRED EMBODIMENT OF THE INVENTION

Figure 1:
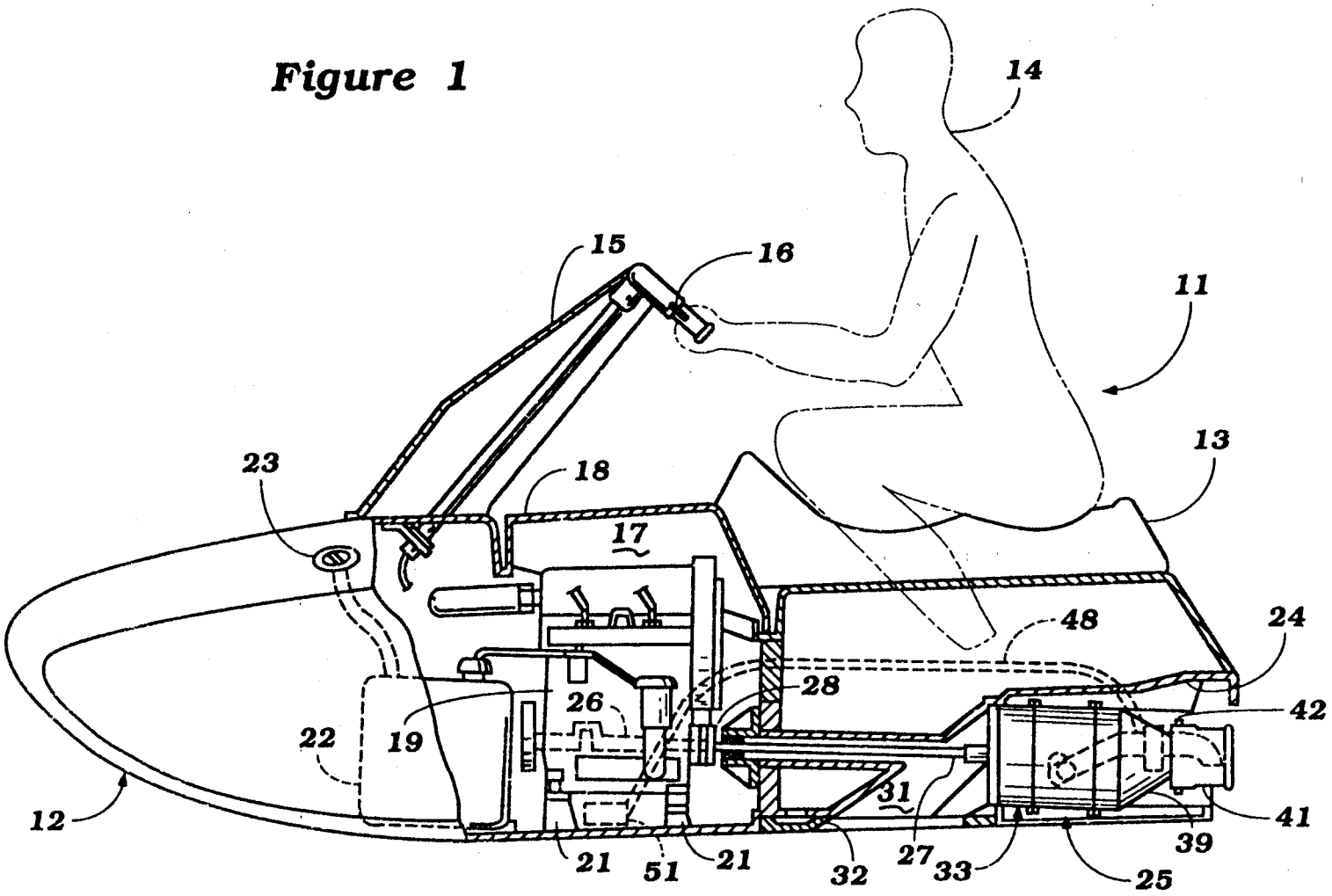
FIG. 1 is a side elevational view of a small watercraft constructed in accordance with an embodiment of the invention, with a portion broken away and shown in section.

Referring first in detail to FIG. 1, a small personal watercraft propelled by a jet propulsion unit constructed in accordance with an embodiment of the invention is identified generally by the reference numeral 11. The watercraft 11 which is illustrated is one of many types of watercraft which may be powered by jet propulsion units embodying the invention. For that reason, the construction of the watercraft 11 will be described only generally, inasmuch as those skilled in the art will readily understand how the invention can be utilized with a wide variety of other types of watercraft.

The watercraft 11 is comprised of a hull assembly, indicated generally by the reference numeral 12, which may be made of one or more parts formed from a material such as a molded fiberglass reinforced resin and which parts are secured to each other in a suitable manner. A passenger's area is provided to the rear and center of the hull 12 and provides a seat 13 that is designed to accommodate at least one rider seated in straddle fashion, such rider being shown in phantom and identified by the reference numeral 14. A mast 15 is provided forwardly of the seat 13 and carries a handlebar assembly 16 by which the rider 14 may control the watercraft.

The area immediately forwardly of the seat 13 and under the mast 15 is provided with a storage compartment 17 which may be accessible through a removable hatch cover 18 and which mounts an internal combustion engine 19 on engine mounts 21 within the hull 12 in a well known manner. The engine 19 may be of any known type and is depicted as being of the two cylinder in-line type operating on the crankcase compression two cycle principle. It is to be understood, however, that various other types of engines may be employed without departing from the invention. The engine 19 is also water cooled with the coolant being delivered to the engine 19 from the body of water in which the watercraft is operating in any type of manner, one of which will be described.

A fuel tank 22 is positioned forwardly in the compartment 17 and has an externally accessible fill neck 23 through which fuel can be added for the engine 19. Various other components for operation of the engine 19 and other auxiliaries for the watercraft such as batteries or the like may also be positioned in the storage area 17.

Beneath the seat 13 and rearwardly of the storage compartment 17, the hull is formed with a tunnel 24 in which a jet propulsion unit, indicated generally by the reference numeral 25, is positioned. The engine 19 has its output shaft 26 coupled to an impeller shaft 27 of the jet propulsion unit 25 by means of a flexible coupling 28.

Figure 2:
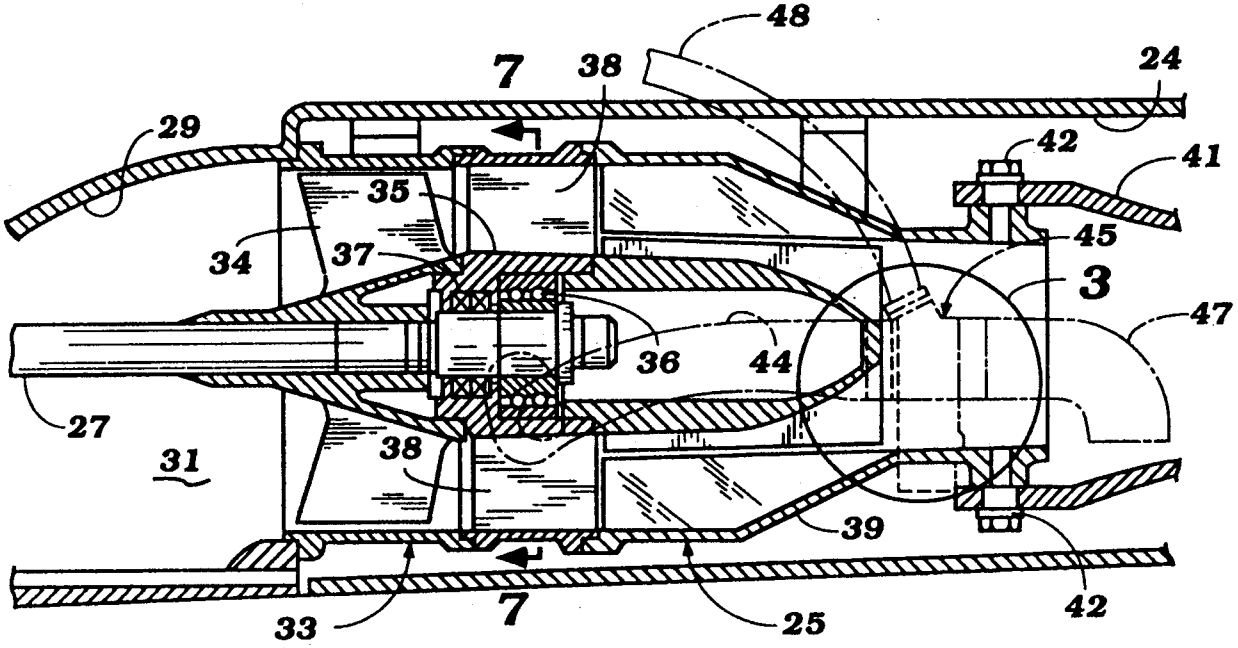
FIG. 2 is an enlarged cross-sectional view taken through the jet propulsion unit.
Figure 3:
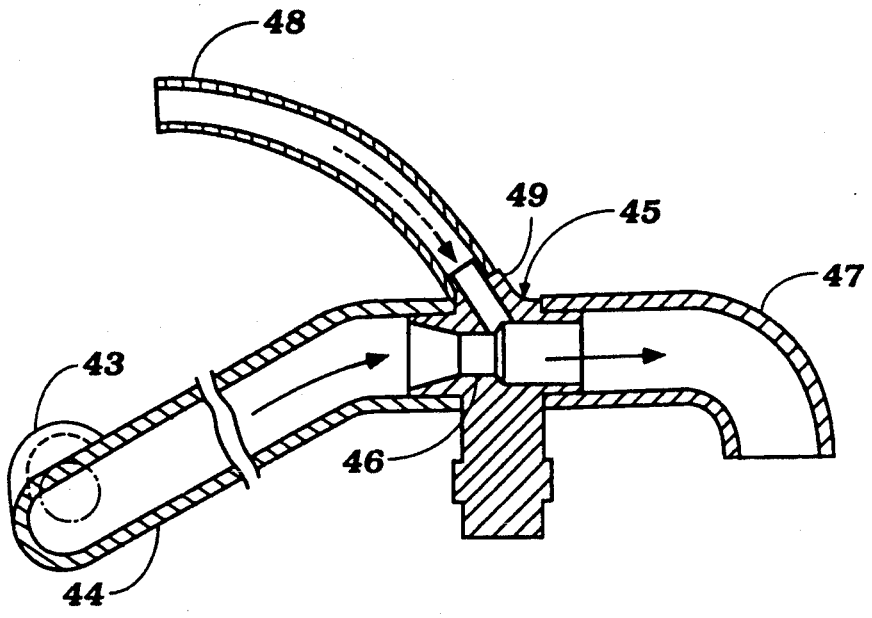
FIG. 3 is an enlarged view taken of the area generally encompassed within the circle 3 of FIG. 2, but with the jet propulsion unit removed to more clearly show the conduitry for drawing off the external water.
Figure 4:
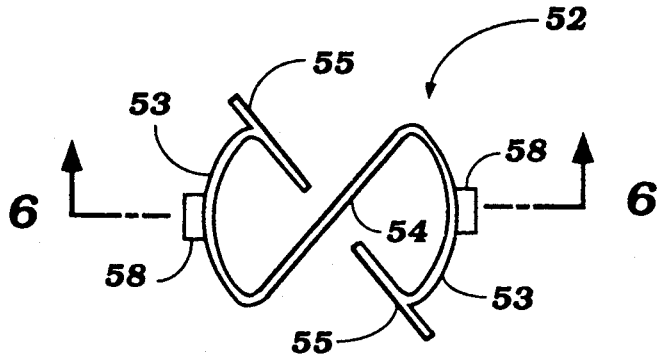
FIG. 4 is an enlarged end elevational view of the filter constructed in accordance with an embodiment of the invention.
Figure 5:
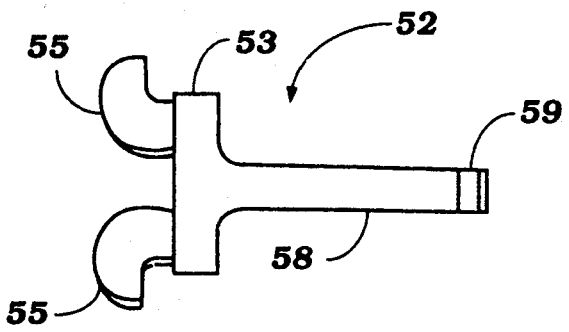
FIG. 5 is a side elevational view of the filter element.
Figure 6:
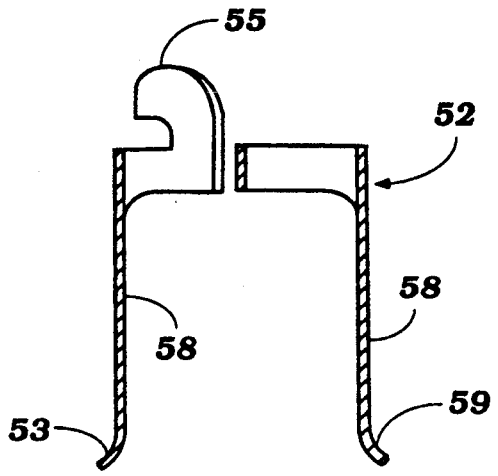
FIG. 6 is a cross-sectional view of the filter element taken along the line 6—6 of FIG. 4.

The construction of the jet propulsion unit 25 will be described in more detail by reference to FIG. 2. It is to be understood, however, that the description of the jet propulsion unit 25 is to be considered typical of only one type of jet propulsion unit with which the invention may be utilized. Various other types of jet propulsion units may be employed in conjunction with the invention, as will be readily apparent to those skilled in the art.

The jet propulsion unit 25 includes a water inlet portion 29, which may be formed in part by the hull 12 and which defines a water inlet opening 31 that communicates with the body of water in which the watercraft is operating through a downwardly facing water inlet opening 32 formed in the lower portion of the hull.

The impeller shaft extends through the water inlet opening 31 and enters into a jet propulsion unit housing assembly, indicated generally by the reference numeral 33, in which an impeller 34 is positioned, which impeller 34 is either fixed to or made integrally with the impeller shaft 27. The rear end of the impeller shaft 27 is journaled within a nacelle 35 of the housing assembly 33 by bearings 36 with a water seal 37 being formed at one end of the bearings 36 within the nacelle 35.

The nacelle 35 has a plurality of straightening vanes 38 formed integrally with it which lead to a discharge nozzle portion 39 of the jet propulsion unit housing 33. Water which has been pumped through the inlet 31 by the impeller 34 will be driven rearwardly and straightened by the straightening vanes 38 for discharge through the discharge nozzle portion 39.

A steering nozzle 41 is supported for steering movement about a generally vertically extending steering axis by pivot pins 42 and registers with the end of the discharge nozzle 39. The steering nozzle 41 is steered by the handlebar assembly 16 in a well known manner.

The construction of the jet propulsion unit 25 as thus far described may be considered to be conventional and, as has been previously noted, the invention can be practiced with a wide variety of types of jet propulsion units. As is typical, the jet propulsion unit 25 may also be provided as a source of auxiliary water pressure for a variety of purposes and to this end, the jet propulsion unit outer housing 33 is provided with a water tap fitting 43 (FIGS. 3, 7, 9 and 10). The water tap fitting 43 is formed in proximity to the straightening vanes 38 and will provide a source of water under pressure that can be delivered to a flexible conduit 44. In the illustrated embodiment, the water is employed for operating a venturi type jet pump 45 (FIG. 3) that has a venturi section 46 through which the pumped water passes before being discharged back into the body of water in which the watercraft is operating through a discharge 47 which is disposed within the tunnel area 24.

A bilge line 48, which may also be a flexible conduit, extends from a further fitting 49 of the venturi section 45 that cooperates with the throat 46 for drawing water from the bilge area through a strainer 51 (positioned in the bilge at the lower portion of the storage compartment 17 as shown in FIG. 1). Hence, the venturi pump 45 will act to pump the bilge dry when the jet propulsion unit 25 is in operation. In addition, the water tap 43 may be employed to supply cooling water to the cooling jacket of the engine 19.

As should be readily apparent, foreign objects may be drawn through the water inlet opening 32 by the operation of the impeller 34. This is true even if a screen is placed across the water inlet opening 32. Such small articles as may pass through the screen will not normally interfere with the operation of the jet propulsion unit 25. However, such articles can easily clog the conduit 44 and specifically the venturi section throat 46. Also, these particles could clog any passage going to the cooling jacket of the engine.

In order to avoid these problems, there is provided a filter element, indicated generally by the reference numeral 52, and having a construction as best shown in FIGS. 4–10. This filter element 52 may be conformed conveniently from a molded piece of plastic and has sufficient flexibility so as to be easily inserted into the water tap 43 in a manner which will be described. This construction also permits the filter element 52 to be easily removed for servicing through removal of the flexible conduit 44, as will become apparent to those skilled in the art.

Filter element 52 has an upper filtering portion that is adapted to extend into the throat of the water tap 43 and which has a generally S-shaped configuration formed by a pair of curved sections 53 which are joined by a straight section 54. In addition, hook-like tabs 55 are formed at the upper or inner ends of the curved portions 53 and are adapted to snap into locking engagement with the water tap 43, as clearly shown in FIG. 7 when fully inserted therein. This filter thus forms restricted areas 56 between the curved portions 53 and the straight section 54 and other portions 57 between the ends of the locking tabs 55 and the straight portions 54, which areas are small enough to trap any objectionable foreign articles which might otherwise be drawn into the conduit 44 and clog the venturi section 46.

In addition, the filter element 52 includes a pair of leg portions 58 having outwardly extending tabs 59 formed at the ends opposite to the filter portion 53.

Figure 7:
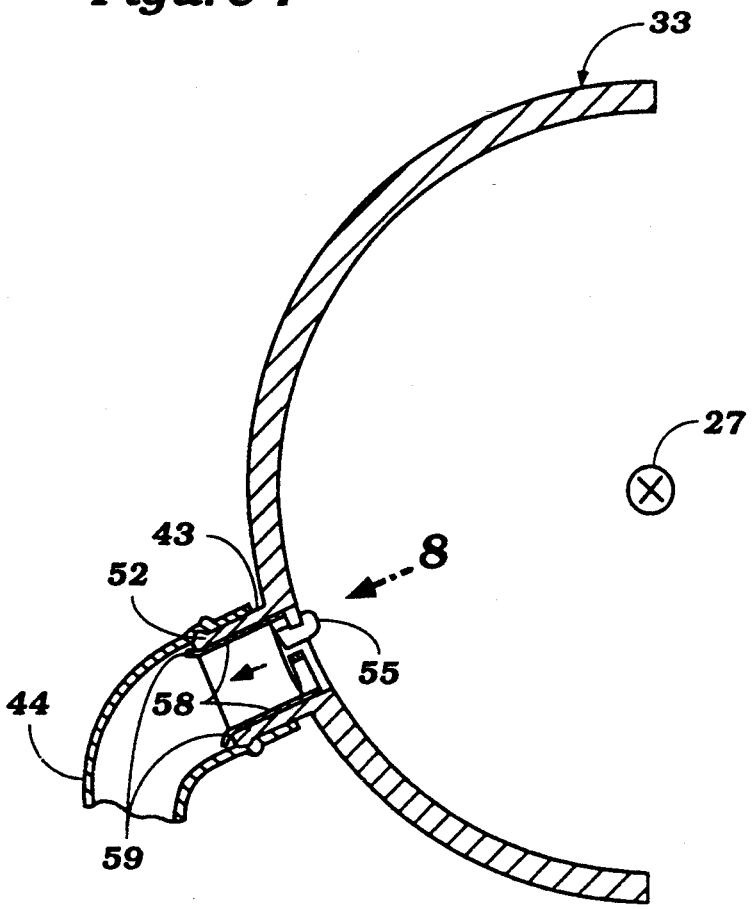
FIG. 7 is an enlarged cross-sectional view taken along the line 7—7 of FIG. 2.
Figure 8:
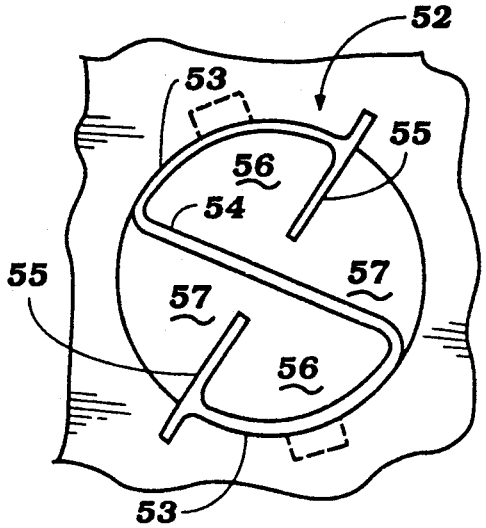
FIG. 8 is an elevational view taken in the direction of the arrow 8 in FIG. 7 and shows how the filter element is retained within the discharge conduit.
Figure 9:
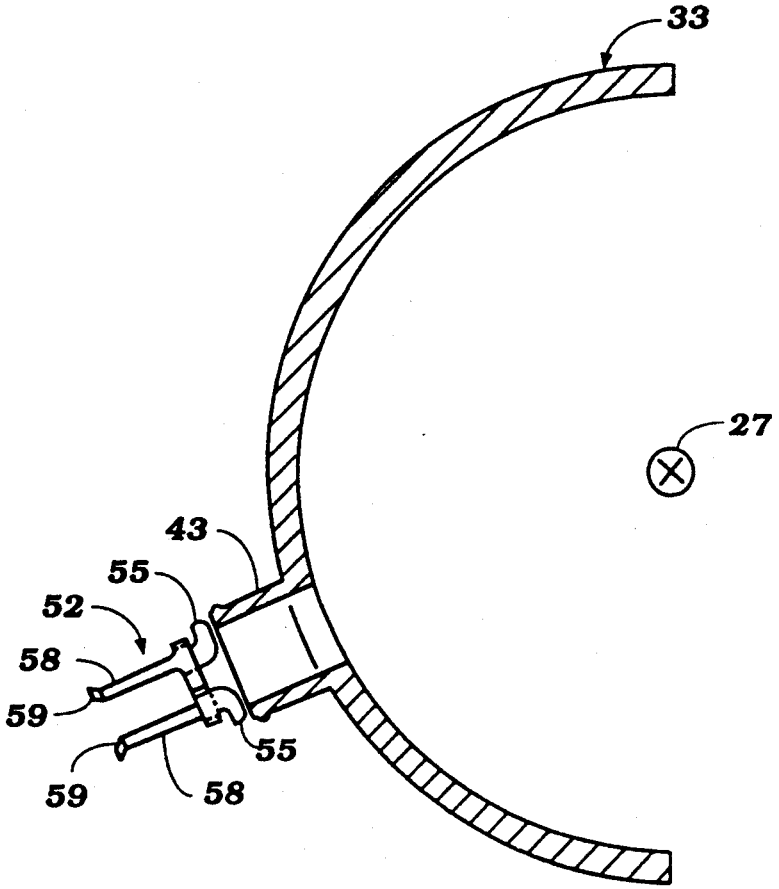
FIG. 9 is a view in part similar to FIG. 7 and shows the filter element before it is installed in the conduit.
Figure 10:
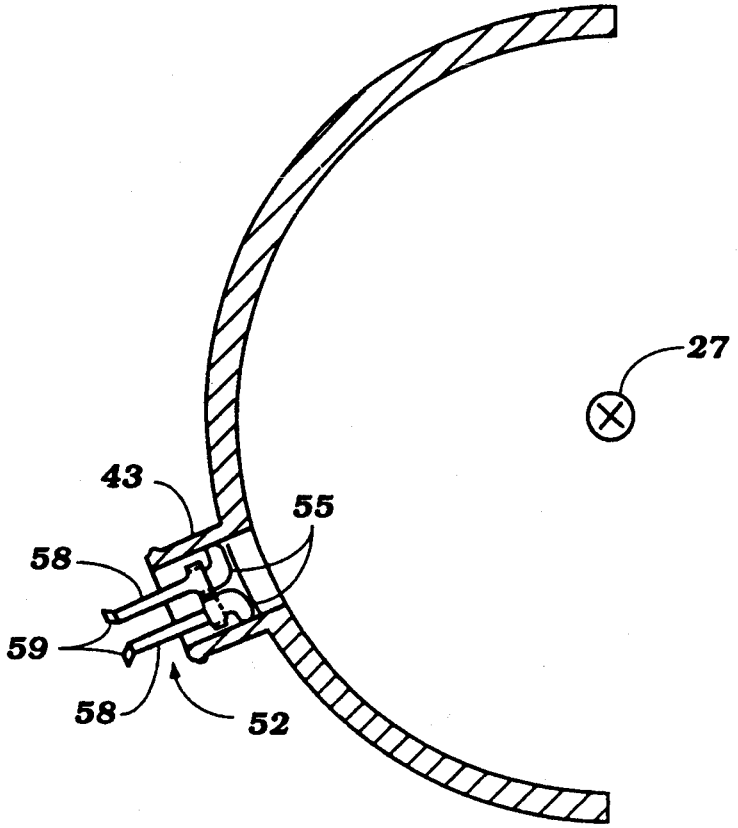
FIG. 10 is a cross-sectional view, in part similar to FIGS. 7 and 9, and shows the filter element partially installed in the conduit.

As may be readily seen in FIG. 9, the tabs 55 are generally spaced apart a distance greater than the diameter of the water tap 43. Thus, to insert the filter device 52 into the water tap 43, the tabs 55 must be compressed toward each other so as to permit the filter element 52 to be slid into the water tap as shown in FIG. 10. Once the filter element 52 is slid into the water tap 43 and the locking tabs 55 extend beyond the end of the water tap 43 and into the portion of the jet propulsion unit housing 33 where the straightening blades 38 are formed, the locking tabs 55 will snap into locking engagement as shown in FIG. 7. At the same time, the tabs 59 at the ends of the legs 58 will engage the other end of the water tap 43 so as to hold the filter unit 52 in position. The conduit 44 may then be assembled and the device is ready for operation.

If at any time the operator realizes that the filter element 52 may become clogged, the filter element 52 may be easily removed for servicing by removing the conduit 44 and again compressing the tabs 55 for removal in the direction opposite of the direction of insertion. Hence, the device is extremely simple and yet easy to service.

It should be readily apparent that the foregoing description is that of a preferred embodiment of the invention and that various changes and modifications may be made without departing from the spirit and scope of the invention as defined by the appended claims.

We claim:

1. A jet propulsion unit for a watercraft, said jet propulsion unit being comprising a water inlet section through which water may be drawn from the body of water in which the watercraft is operating, an impeller section containing an impeller for pumping water, a discharge nozzle through which the water pumped by the impeller is discharged, and a water outlet tap from which a portion of the water pumped by said impeller may be discharged, a conduit having an inlet end detachably connected to said jet propulsion unit water outlet tap for receiving water pumped by said impeller and for circulating at least a portion of the water pumped by said impeller to another location, and a filter in said inlet end of said conduit for preventing foreign particles from entering said conduit.

2. A jet propulsion unit as set forth in claim 1 wherein the filter element is provided in the water tap.

3. A jet propulsion unit as set forth in claim 1 wherein the the other end of the conduit cooperates with a jet pump having a venturi section for pumping the bilge of the associated watercraft.

4. A jet propulsion unit as set forth in claim 3 wherein the filter element is provided in the water tap.

5. A jet propulsion unit as set forth in claim 1 wherein the filter element is comprised of an S-shaped section adapted to be inserted into the water outlet tap and having a pair of tab ends adapted to be snapped into locking engagement with the end of the conduit.

6. A jet propulsion unit as set forth in claim 5 further including a pair of resilient legs extending from the curved sections of the S-shaped portion and having tabs at their opposite ends adapted to engage another portion of the water outlet tap for locking the filter element in the conduit.

7. A jet propulsion unit for a watercraft comprising a water inlet section through which water may be drawn for the body of water in which the watercraft is operating, an impeller section containing an impeller for pumping water, and a discharge nozzle through which the water pumped by the impeller is discharged, a conduit connected to said jet propulsion unit for circulating at least a portion of the water pumped by said impeller to another location, and a filter in said conduit for preventing foreign particles from entering said conduit, said filter element being comprises of an S-shaped section adapted to be inserted into said conduit and having a pair of tab ends adapted to be snapped into locking engagement with the end of said conduit.

8. A jet propulsion unit as set forth in claim 7 wherein the ends comprise a pair of resilient legs extending from the curved sections of the S-shaped portion and having tabs at their opposite ends adapted to engage another portion of the conduit for locking the filter element in the conduit.

9. A jet propulsion unit as set forth in claim 8 wherein the conduit comprises a water tap formed on the housing of the jet propulsion unit and a flexible conduit detachably connected to said water tap.

10. A jet propulsion unit as set forth in claim 8 wherein the filter element is provided in the inlet to the conduit.

11. A jet propulsion unit as set forth in claim 10 wherein the conduit comprises a water tap formed on the housing of jet propulsion unit and a flexible conduit detachably connected to said water tap and the filter element is positioned in the water tap.

12. A jet propulsion unit as set forth in claim 11 wherein the flexible conduit is readily removable from the water tap for removal of the filter element.

* * * * *